US007893333B2

(12) United States Patent
Harrison

(10) Patent No.: US 7,893,333 B2
(45) Date of Patent: Feb. 22, 2011

(54) BRASS-WIND MOUTHPIECE

(75) Inventor: David W. Harrison, Vancouver (CA)

(73) Assignee: Harrison Mouthpieces Inc., Vancouver, BC (CA)

( * ) Notice: Subject to any disclaimer, the term of this patent is extended or adjusted under 35 U.S.C. 154(b) by 0 days.

(21) Appl. No.: 12/600,645

(22) PCT Filed: May 20, 2008

(86) PCT No.: PCT/CA2008/000967

§ 371 (c)(1),
(2), (4) Date: Nov. 17, 2009

(87) PCT Pub. No.: WO2008/141450

PCT Pub. Date: Nov. 27, 2008

(65) Prior Publication Data

US 2010/0147135 A1 Jun. 17, 2010

(30) Foreign Application Priority Data

May 18, 2007 (CA) ..... 2589302

(51) Int. Cl.
*G10D 7/00* (2006.01)

(52) U.S. Cl. ..... 84/380 R

(58) Field of Classification Search ..... 84/383 A, 84/383 R, 380 R, 385 A
See application file for complete search history.

(56) References Cited

U.S. PATENT DOCUMENTS

| | | | | |
|---|---|---|---|---|
| 1,655,656 | A | 1/1928 | Morris | |
| 1,852,749 | A | 4/1932 | Hiner | |
| 2,376,453 | A | 5/1945 | Ruettiger | |
| 2,594,869 | A | 4/1952 | Cauffman | |
| 3,611,860 | A | 10/1971 | Tichenor | |
| 3,728,929 | A | 4/1973 | Sanders | |
| 7,705,227 | B2 * | 4/2010 | Hamanaga | 84/387 R |

FOREIGN PATENT DOCUMENTS

| | | |
|---|---|---|
| DE | 843051 | 7/1952 |
| DE | 3330459 | 3/1985 |
| DE | 19746559 | 10/1998 |
| DE | 102004023520 | 12/2005 |
| FR | 1217155 | 5/1960 |
| FR | 2834815 | 7/2003 |
| GB | 261419 | 6/1927 |
| GB | 668148 | 3/1952 |
| GB | 2388240 A | 5/2003 |
| JP | 2004061573 | 2/2004 |
| WO | 97/18548 | 5/1997 |

* cited by examiner

*Primary Examiner*—Kimberly R Lockett
(74) *Attorney, Agent, or Firm*—Clark Wilson LLP; Michael J. Roman

(57) ABSTRACT

The present invention is directed to brass-wind mouthpieces (20), and in particular brass-wind mouthpieces (20) configured for improved performance and endurance. One aspect of the invention provides that the lateral shoulders (38) of the mouthpiece (20) rim (24), which respectively would face the corners of the musician's lips when the mouthpiece (20) is in use, slope outwardly away from the proximate end of the mouthpiece (20) cup (22).

17 Claims, 4 Drawing Sheets

BRASS-WIND MOUTHPIECE

CROSS REFERENCE TO RELATED APPLICATION

This application claims the benefit of priority from application serial number CA2,589,302 filed May 18, 2007.

BACKGROUND OF THE INVENTION

1. Field of the Invention

The present invention is directed to brass-wind mouthpieces, and in particular brass-wind mouthpieces configured for improved performance and endurance.

2. Description of the Related Art

A brass-wind mouthpiece is formed as a cup with a convex rim. A musician places the rim against his lips to play a brass-wind instrument. The rim is therefore the most important interface between instrument and musician.

In greater detail, the cup has the rim at its proximate end and a throat at its distal end. The cup also includes a receptacle for a hollow shank adapted to connect the throat to a mouthpiece-receiver of a brass-wind instrument. The shank has a tubular backbore that conveys air between the cup and the instrument, through a throat in the base of the cup. A musician applies his lips to the mouthpiece rim and blows air into the instrument through the throat and the backbore in the shank. This act causes the musician's upper and lower lips to vibrate, setting up a standing sound wave in the instrument and producing the characteristic sound of the instrument being played.

The rim has a circumferential inside edge, a circumferential outside edge and a surface contour extending between the inside edge and the outside edge.

The contour has a superior abutment adapted to abut a musician's upper lip, an inferior abutment adapted to abut the musician's lower lip, and lateral shoulders adapted to face the corners of the musician's mouth where his upper lip and lower lip meet. The contour also has an impression, which is the path of apex points on the contour around the circumference of the rim, and a bite, which is the portion of the contour between the impression and the inside edge The contour of the rim may be rounded or relatively flat. The contour is generally of uniform radius from the inside edge to outside edge of the rim. The impression of the rim is usually close to its center, but is sometimes biased very slightly to the inside or outside edge over the entire circumference of the rim. The contour of the inside portion of the rim—the bite—may be somewhat sharper than the contour of the outside portion of the rim, but is generally uniform throughout the circumference of the rim.

The musician manipulates the pitch of the note being produced by the instrument, in part by movements of his lips. These movements are a combination of changing the tension in the vibrating lips, puckering, rolling the lips in or out, compressing the upper and lower lips together, and varying mouthpiece pressure against the lips. The net result is a change in the frequency of lip vibrations, resulting in a change of the sounded note. The lips must also be periodically stretched open at their corners and then quickly returned to their original playing position in order to take breath while playing a musical passage.

Conventional mouthpiece rim contours impose significant physical and physiological limitations on the musician, leading to problems of decreased lip mobility, lip and face muscle fatigue, lip swelling, and impaired blood and oxygen supply to the lip tissues inside the mouthpiece. These problems translate into impaired range, lack of endurance and an impaired ability to smoothly move between notes (flexibility). Conventional rims also make it difficult to achieve satisfactory replacement of the lips in their original position after taking a breath.

The present invention addresses these problems.

SUMMARY OF THE INVENTION

One aspect of the present invention provides for a new type of brass-wind mouthpiece having a rim contour that improves both performance and endurance. This new contour can be incorporated into the design and manufacture of a new mouthpiece or applied as a modification to any existing mouthpiece.

In one embodiment, there is provided a mouthpiece having lateral shoulders that slope outwardly away from the proximate end of the cup.

The impression may have a variable radius. So configured, the radius of the impression is shortest proximate the lateral shoulders, where the impression is proximate the inside edge of the rim. The radius of the impression is longest proximate the superior and inferior abutments, where the bite is pronouncedly rounded.

The inside edge may have a smaller radius proximate the shoulders than the abutments, such that the rim presents an ovular opening with its major axis aligned with the upper and lower abutments.

The shoulders may define a dip in the contour toward the distal end of the cup and thereby reduce the volume of the cup.

The bite may be sharper proximate the shoulders than the abutments. The bite is narrower proximate the shoulders than the abutments.

The shoulders might have a flat contour, a rounded contour or a combination and the respective shoulders might even differ in at least one of: contour, angle of slope, and direction of slope. As a result of such asymmetry, the upper abutment and lower abutment might be different sizes.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

(a) Structure of Specific Embodiments

Figure 1:
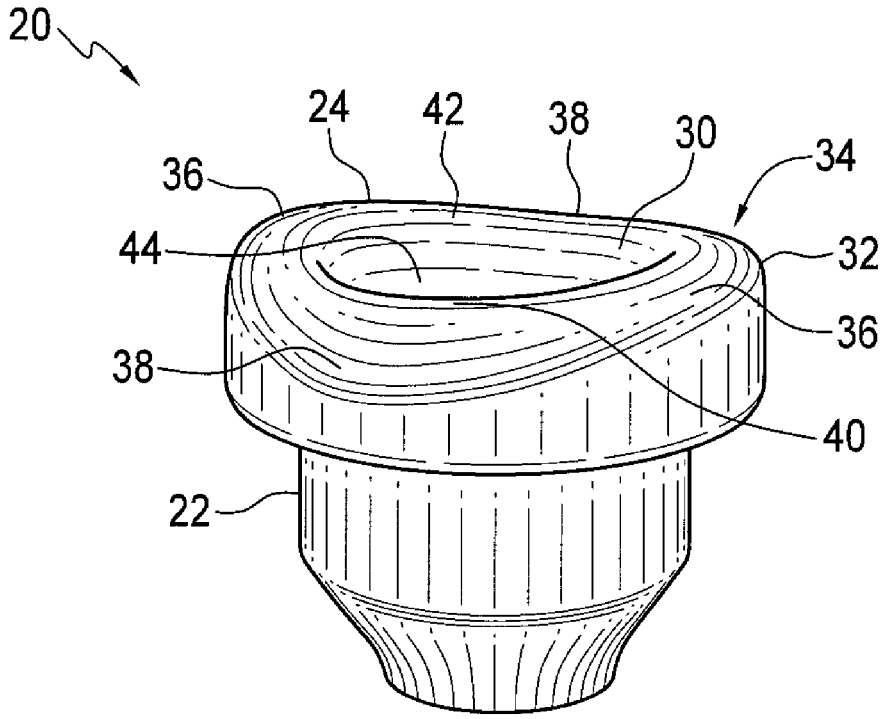
FIG. 1 is a bottom, left, front isometric view of a mouthpiece according to one embodiment of the present invention.
Figure 2:
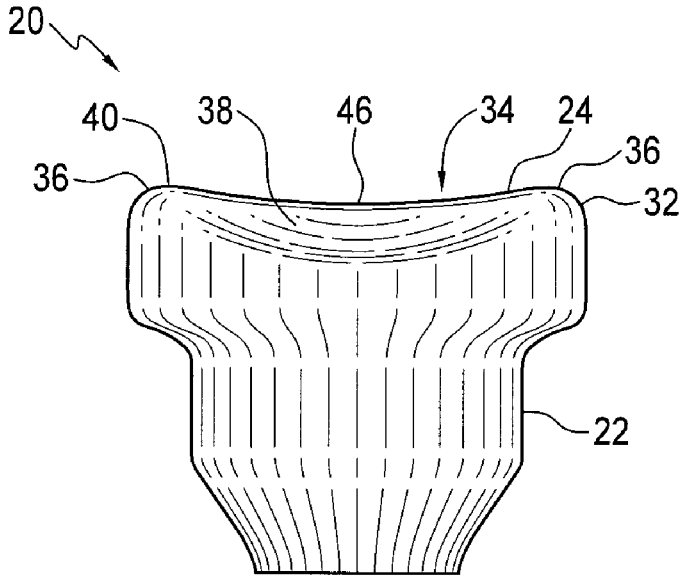
FIG. 2 is a left elevation view of the mouthpiece of FIG. 1.
Figure 3:
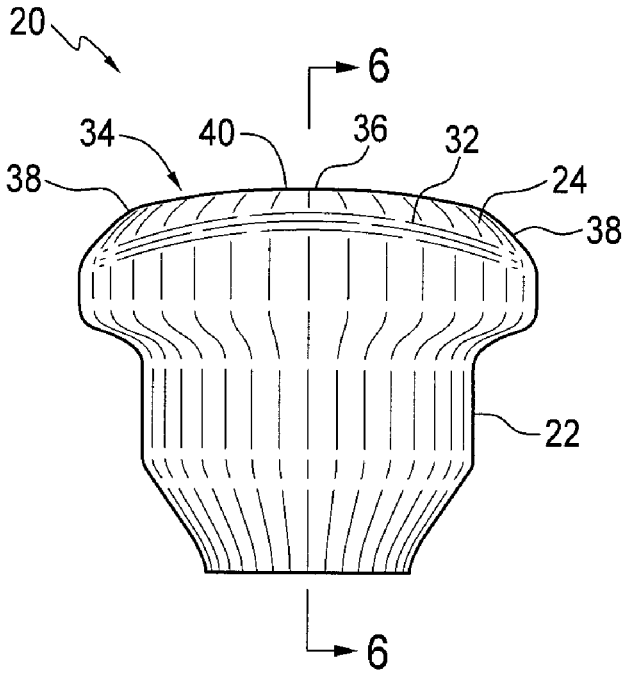
FIG. 3 is a top plan view of the mouthpiece of FIG. 1.
Figure 4:
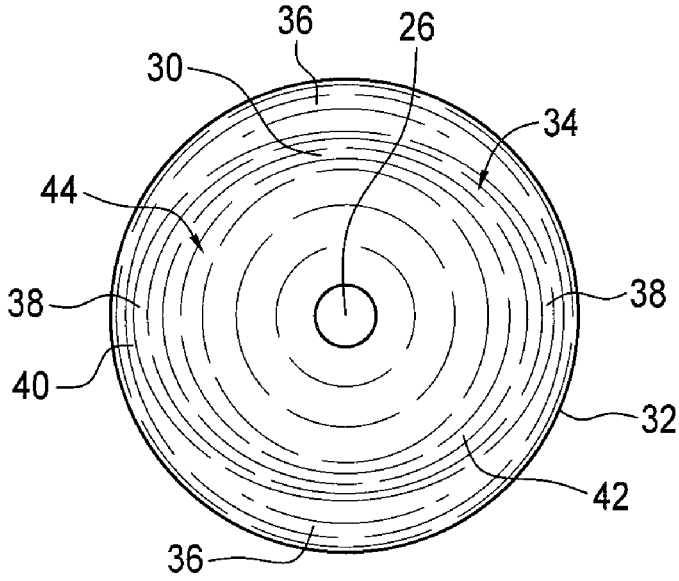
FIG. 4 is a front elevation view of the mouthpiece of FIG. 1.
Figure 5:
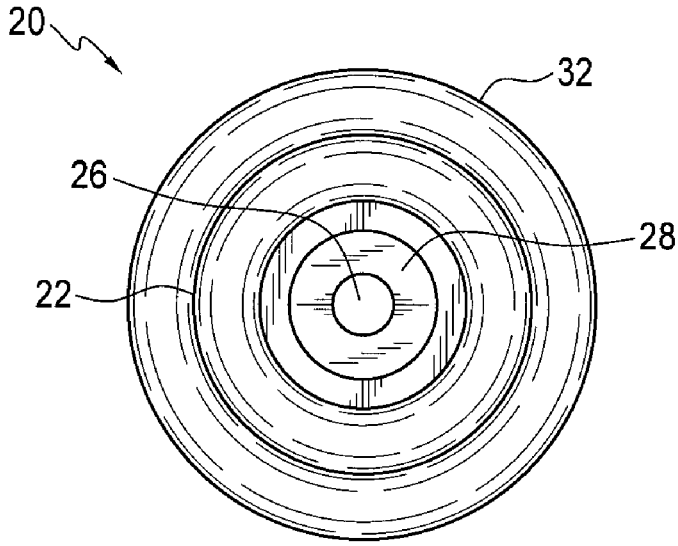
FIG. 5 is a rear elevation view of the mouthpiece of FIG. 1.
Figure 6:
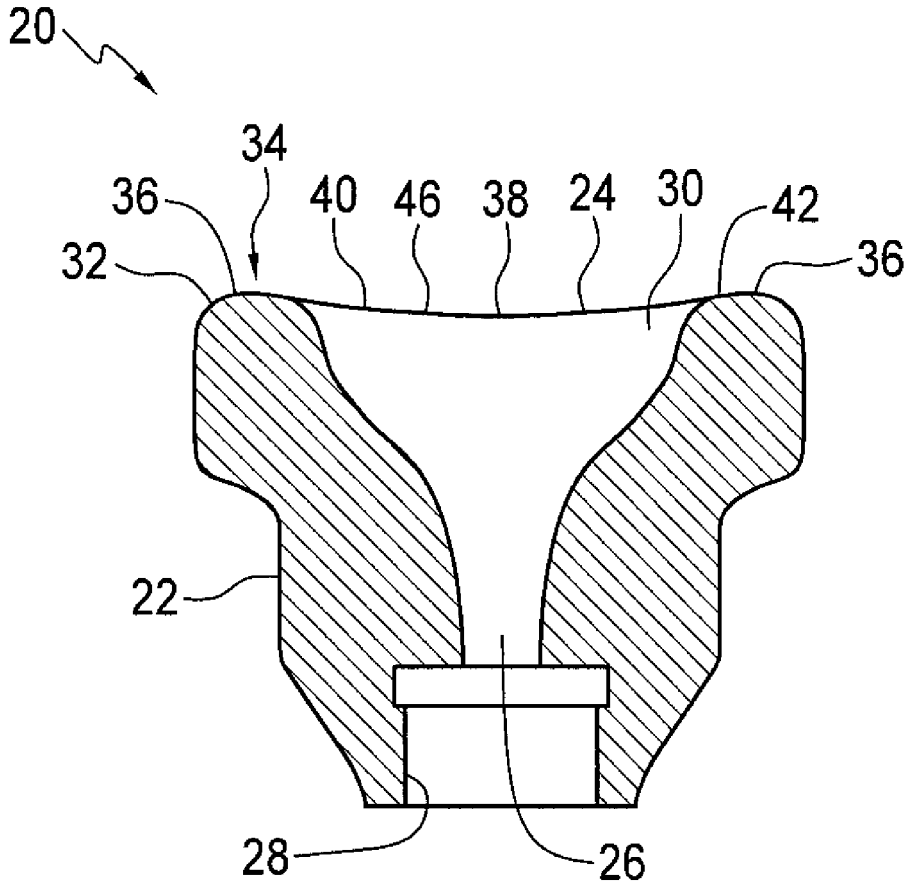
FIG. 6 is a cross-sectional view along the cutting-plane 6-6 of the mouthpiece of FIG. 1.

The structure of the invention will now be illustrated by explanation of specific, non-limiting, exemplary embodiments shown in the drawing figures and described in greater detail herein. The embodiments are characterized by a number of features that can be variously combined.

Referring to the Figures, wherein like numerals indicate corresponding parts throughout the several views, a brass-wind mouthpiece 20 according to one embodiment of the present invention is generally illustrated.

As is conventional, the mouthpiece 20 includes a cup 22 having a rim 24 at its proximate end and a throat 26 at its distal end. The cup 22 either projects or receives in a receptacle 28 a hollow shank (not shown) adapted to connect the throat 26 to a mouthpiece-receiver (not shown) of a brass-wind instrument (not shown).

Also as is conventional, the rim 24 has a circumferential inside edge 30, a circumferential outside edge 32 and a surface contour 34 extending between the inside edge 30 and the outside edge 32. The contour 34 has a superior abutment 36 adapted to abut a musician's upper lip, an inferior abutment 36 adapted to abut the musician's lower lip, and lateral shoulders 38 adapted to face the corners of the musician's mouth where his upper lip and lower lip meet. The contour 34 also has an impression 40, which is the path of apex points on the contour 34 around the circumference of the rim 24, and a bite 42, which is the portion of the contour 34 between the impression 40 and the inside edge 30.

Sloping Lateral Shoulders 38 of the Rim 24

The lateral shoulders 38 of the rim 24, which respectively would face the corners of the musician's lips when the mouthpiece 20 is in use, slope outwardly away from the proximate end of the cup 22. That portion of the shoulders 38 that would be in close contact with the lips is therefore significantly narrower than the superior and inferior abutments 36 of the rim 24. This configuration is opposite to previously taught contour 34 variations for a rim 24, which have tended to have uniform radius or to slope into the mouthpiece 20 cup 22, but not away.

Varying Rim 24 Contour 34 and Impression 40

The impression 40 and contour 34 of the rim 24 vary along the circumference of the rim 24.

The impression 40 has a variable radius. The radius of the impression 40 is shortest proximate the lateral shoulders 38, where the impression 40 is proximate the inside edge 30 of the rim 24. The radius of the impression 40 is longest proximate the superior and inferior abutments 36, where the bite 42 is pronouncedly rounded.

Rim 24 Contour 34 Shifted Medially Toward Center

In proportion to the degree of slope of the shoulders 38, the plane of the metal removed impinges on the inside edge 30 of the cup 22. This relationship has the effect of moving the inside edge 30 medially and contributing to a slightly oval shape to the cup 22. The longitudinal axis of the oval is oriented in a superior and inferior direction when the instrument is played, contrary to the orientation of other oval mouthpiece 20 designs.

Thus, the inside edge 30 has a smaller radius proximate the shoulders 38 than the abutments 36, such that the rim 24 presents an ovular opening 44 with its major axis aligned with the upper and lower abutments 36. The cup 22 presents the oval opening due to a combination of the medially shifted lateral contour 34 of the rim 24 in conjunction with the pronounced rounding of the inner rim 24 contour 34 superiorly and inferiorly.

Lateral Dip 46 of Rim 24 Contour 34

The sloping of the shoulders 38 also introduces a lateral dip 46 in the side profile of the rim 24. This lateral dip 46 arises as a secondary characteristic from the sloping of the lateral shoulders 38 of the rim 24, and is designed to be a more acute curve than that formed by the contour 34 of the musician's supporting lips and teeth, in order to create a pressure differential between the shoulders 38 and the superior and inferior abutments 36 of the rim 24. This contour 34 of the rim 24 is distinct from previous designs, which have sought to match the contour 34 of the musician's lips and teeth in order to distribute pressure evenly.

The lateral dip 46 is also unique in that it is associated with a rim 24 contour 34 that steeply slopes to the outside in the perpendicular axis of the rim 24 at the same location. The shoulders 38 define a dip 46 in the contour 34 toward the distal end of the cup 22 and thereby reduce the volume of the cup 22.

Variable Inner Rim 24 Sharpness (or Bite 42)

The variable contour 34 of the rim 24 produces a variable bite 42, being sharper and narrower laterally at the shoulders 38 than superiorly and inferiorly at the superior and inferior abutments 36.

(b) Operation of Specific Embodiments

The operation of these specific embodiments of the invention will now be described.

The contour 34 of the rim 24 interacts with the musician's anatomy and physiology in a unique way. The sloping lateral shoulders 38 leave space for the lip tissue to expand and grip the mouthpiece 20 while contracting and puckering to play a higher note. This arrangement improves range, endurance, and flexibility. The increased space for lip movement also improves the ability to open the corners of the lips for a breath, and to then replace them to their original position without the difficulty associated with conventional rims 24. The critical central vibrating portions of the upper and lower lips are pinned in place by the relatively wider superior and inferior abutments 36 of the rim 24 while the lateral lips are able to move while breathing. The decrease in the volume of the cup 22 is minimal and does not appreciably affect the tone of the instrument.

The maximum pressure point between conventional rims 24 and the lips is at the lateral margin of the rim 24. This is because the natural convexity of the anterior surface to the slightly open teeth (as they are positioned for playing) produces an anatomical high point where the lips meet under the lateral mouthpiece 20 rim 24. The arterial blood supply courses from lateral to medial. Venous and lymphatic drainage of the lips courses from medial to lateral. Pressure of the lateral rim 24 of conventional mouthpieces 20 impairs blood and lymph flow at this point, resulting in impaired blood supply, oxygen and nutrient starvation of the central lip tissues, decreased lymphatic and venous blood drainage, and lip swelling. Impedance to flow is a function of the degree of compression of vessels, and the length of the vessel over which that restriction is applied. These factors produce musician fatigue and impaired endurance and general playing ability.

Other oval mouthpiece 20 designs have sought to evenly distribute the mouthpiece 20 pressure around the entire circumference of the rim 24. The sloping lateral shoulders 38 of the present embodiments seek to offload pressure from the lateral portions of the rim 24 to an even greater degree, thereby producing the opposite effect of concentrating pressure on the superior and inferior abutments 36 of the rim 24. The decreased pressure acting over a shorter length of local vascular structures improves blood and lymphatic flow, which decreases lip swelling and fatigue. It also increases lip mobility in this area, since less surface area of the lip and rim 24 are in contact, decreasing the amount of friction between the surfaces.

Transfer of a greater proportion of surface area of contact from the shoulders 38 to the relatively wider superior and inferior abutments 36 of the rim 24, which lie over the smooth surfaces of the teeth instead of the sharp teeth edges 30, 32, also improves comfort for any given degree of mouthpiece 20 pressure.

Thus, it will be seen from the foregoing embodiments and examples that there has been described a way to improve comfort, endurance, range, and flexibility without any sacrifice in tone or other paying characteristics of any given mouthpiece 20 cup 22.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. In addition, the reference numerals in the claims are merely for convenience and are not to be read in any way as limiting.

While specific embodiments of the invention have been described and illustrated, such embodiments should be considered illustrative of the invention only and not as limiting the invention. It will be understood by those skilled in the art that various changes, modifications and substitutions can be made to the foregoing embodiments without departing from the principle and scope of the invention as defined in the claims.

For example, the slope of the shoulders 38 can vary in contour 34, angle and orientation. The contour 34 of the sloping shoulders 38 can be flat or rounded. The slope will affect the overall width the mouthpiece 20 and degree of ovate shape of the cup 22. The orientation of the slope of the two lateral shoulders 38 can be parallel or angled with respect to one another. Angled orientations will produce an inequality between the lengths of the superior and inferior abutments 36 of the rim 24. In playing the instrument the wider or narrower segments of the rim 24 can be placed on the top or bottom lip depending on musician preference.

Thus useful embodiments would include shoulders 38 having a flat contour 34, a rounded contour 34, or a combination, upper abutments 36 that are either larger or smaller than their corresponding lower abutments 36, and respective shoulders 38 differing in at least one of: contour 34, angle of slope, and direction of slope.

What is claimed is:

1. A brass-wind mouthpiece for connection to a mouthpiece-receiver of a brass-wind instrument via a hollow shank adapted to connect the mouthpiece to the mouthpiece-receiver, comprising:

a cup having a rim at its proximate end and a throat at its distal end, the distal end having a receptacle for the hollow shank to connect the throat to the mouthpiece-receiver of the brass-wind instrument, the rim having a circumferential inside edge, a circumferential outside edge and a surface contour extending between the inside edge and the outside edge, the contour having a superior abutment adapted to abut a musician's upper lip, an inferior abutment adapted to abut the musician's lower lip, and lateral shoulders adapted to face the corners of the musician's mouth where his upper lip and lower lip meet, the contour further having an impression that is the path of apex points on the contour around the circumference of the rim and a bite that is the portion of the contour between the impression and the inside edge and characterized by, the lateral shoulders sloping outwardly away from the proximate end of the cup;

the impression having a variable radius, the radius of the impression being shortest proximate the lateral shoulders, where the impression is proximate the inside edge and the radius of the impression being longest proximate the superior and inferior abutments, where the bite is pronouncedly rounded;

the inside edge having a smaller radius proximate the lateral shoulders than the abutments such that the rim presents an ovular opening with its major axis aligned with the upper and lower abutments;

the shoulders defining a dip in the contour toward the distal end of the cup and thereby reducing the volume of the cup;

the bite being sharper proximate the shoulders than the superior and inferior abutments; and the bite being narrower proximate the shoulders than the superior and inferior abutments.

2. A brass-wind mouthpiece having a cup with a rim at its proximate end and a throat at its distal end, the rim having a circumferential inside edge, a circumferential outside edge and a surface contour extending between the inside edge and the outside edge, the contour having a superior abutment adapted to abut a musician's upper lip, an inferior abutment adapted to abut the musician's lower lip, and lateral shoulders adapted to face the corners of the musician's mouth where his upper lip and lower lip meet, the contour further having an impression that is the path of apex points on the contour around the circumference of the rim and a bite that is the portion of the contour between the impression and the inside edge, characterized by the lateral shoulders sloping outwardly away from the proximate end of the cup.

3. A brass-wind mouthpiece as set forth in claim 2 further characterized by the impression having a variable radius.

4. A brass-wind mouthpiece as set forth in claim 3, further characterized by the radius of the impression being shortest proximate the shoulders.

5. A brass-wind mouthpiece as set forth in claim 4, further characterized by the impression proximate the shoulders being proximate the inside edge.

6. A brass-wind mouthpiece as set forth in claim 4, further characterized by the radius of the impression being longest proximate the abutments.

7. A brass-wind mouthpiece as set forth in claim 6, further characterized by the bite being pronouncedly rounded proximate the abutments.

8. A brass-wind mouthpiece as set forth in claim 2 further characterized by the inside edge having a smaller radius proximate the shoulders than the abutments.

9. A brass-wind mouthpiece as set forth in claim 8 further characterized by the rim presenting an ovular opening with its major axis aligned with the upper and lower abutments.

10. A brass-wind mouthpiece as set forth in claim 2 further characterized by the shoulders defining respective dips in the contour toward the distal end of the cup.

11. A brass-wind mouthpiece as set forth in claim 10 further characterized by the dips reducing the volume of the cup.

12. A brass-wind mouthpiece as set forth in claim 2 further characterized by the bite being sharper proximate the shoulders than the abutments.

13. A brass-wind mouthpiece as set forth in claim 12 further characterized by the bite being narrower proximate the shoulders than the superior and inferior abutments.

14. A brass-wind mouthpiece as set forth in claim 2 further characterized by the shoulders having a flat contour.

15. A brass-wind mouthpiece as set forth in claim 2 further characterized by the shoulders having a rounded contour.

16. A brass-wind mouthpiece as set forth in claim 2 further characterized by the upper abutment and lower abutment being different sizes.

17. A brass-wind mouthpiece as set forth in claim 2 further characterized by the respective shoulders differing in at least one of: contour, angle of slope, and direction of slope.

* * * * *